US011492691B2

(12) United States Patent
Greene

(10) Patent No.: US 11,492,691 B2
(45) Date of Patent: Nov. 8, 2022

(54) CASE HARDENED TITANIUM PARTS AND METHOD FOR MAKING THE SAME

(71) Applicant: The Boeing Company, Chicago, IL (US)

(72) Inventor: Joseph M. Greene, West Chester, PA (US)

(73) Assignee: THE BOEING COMPANY, Chicago, IL (US)

( * ) Notice: Subject to any disclaimer, the term of this patent is extended or adjusted under 35 U.S.C. 154(b) by 722 days.

(21) Appl. No.: 16/522,560

(22) Filed: Jul. 25, 2019

(65) Prior Publication Data

US 2021/0025017 A1 Jan. 28, 2021

(51) Int. Cl.

| | |
|---|---|
| ***C22F 1/18*** | (2006.01) |
| ***C21D 1/25*** | (2006.01) |
| ***C21D 1/06*** | (2006.01) |
| ***C23C 8/30*** | (2006.01) |
| ***C22C 14/00*** | (2006.01) |

(52) U.S. Cl.

CPC ..... *C22F 1/183* (2013.01); *C21D 1/06* (2013.01); *C21D 1/25* (2013.01); *C22C 14/00* (2013.01); *C23C 8/30* (2013.01)

(58) Field of Classification Search

CPC ... C21D 1/02; C21D 1/06; C21D 1/18; C21D 1/25; C22C 14/00; C22C 1/0458; C22C 21/003; C22C 32/0031; C22C 38/14; C22C 38/28; C22C 38/50; C22C 45/10; C22C 49/11; C23C 8/06; C23C 8/30; C23C 8/32; C22F 1/183

See application file for complete search history.

(56) References Cited

U.S. PATENT DOCUMENTS

| | | | | |
|---|---|---|---|---|
| 1,571,289 | A | 12/1920 | Merten | |
| 2,339,223 | A * | 1/1944 | Holt | C23C 8/50 148/218 |
| 5,100,483 | A * | 3/1992 | Rhoads | C23C 8/80 148/226 |
| 6,833,197 | B1 | 12/2004 | Dong et al. | |
| 7,186,304 | B2 | 3/2007 | Chin et al. | |
| 8,496,872 | B1 | 7/2013 | Weires et al. | |
| 8,580,051 | B2 | 11/2013 | Chin et al. | |
| 9,790,583 | B2 | 10/2017 | Weires et al. | |
| 2004/0045636 | A1* | 3/2004 | Poirier | C23C 8/36 427/249.1 |
| 2008/0057280 | A1* | 3/2008 | Watanabe | C23C 16/36 427/255.28 |

FOREIGN PATENT DOCUMENTS

| | | | | |
|---|---|---|---|---|
| GB | 287156 | A * | 12/1928 | C23C 8/26 |

* cited by examiner

*Primary Examiner* — Anthony J Zimmer
*Assistant Examiner* — Dean Mazzola
(74) *Attorney, Agent, or Firm* — MH2 Technology Law Group LLP

(57) ABSTRACT

A method of case hardening a titanium part, including placing the titanium part within a chamber; evacuating or purging the chamber; heating the titanium part placed within the chamber; introducing a gas containing cyanogen into the chamber; and exposing the titanium part placed within the chamber to the introduced gas containing cyanogen.

20 Claims, 4 Drawing Sheets

CASE HARDENED TITANIUM PARTS AND METHOD FOR MAKING THE SAME

TECHNICAL FIELD

The present disclosure generally relates to a case hardening method, and more particularly, to a system and method to case harden titanium parts.

BACKGROUND

Articles or parts made of titanium or titanium alloys offer certain advantages over other types of metals or metal alloys. For example, titanium parts may provide an increased strength to weight advantage over steel parts. However, titanium parts may not have sufficient hardness for high-stress contact applications, such as gearing or bearings, and may be prone to galling, scoring, or fretting.

Surface hardening may be used to harden the contact or exterior surfaces of a titanium part while leaving the core material unchanged in terms of composition and physical properties. However, present case hardening methods for titanium articles require high processing temperatures, the use of molten salts, or may expose the titanium article to oxygen and/or hydrogen during the case hardening process which may contribute to the brittleness of the titanium part.

Accordingly, there is a need for systems and methods to harden titanium and titanium alloys parts which reduce the processing temperature required while also reducing or eliminating the exposure to oxygen and/or hydrogen, avoiding the use of molten salts, and/or facilitating the removal of by-products during the case hardening process.

BRIEF SUMMARY

This summary is intended merely to introduce a simplified summary of some aspects of one or more implementations of the present disclosure. This summary is not an extensive overview, nor is it intended to identify key or critical elements of the present teachings, nor to delineate the scope of the disclosure. Rather, its purpose is merely to present one or more concepts in simplified form as a prelude to the detailed description below.

The foregoing and/or other aspects and utilities embodied in the present disclosure may be achieved by providing a method of case hardening a titanium part, including placing the titanium part within a chamber; evacuating or purging the chamber; heating the titanium part placed within the chamber; introducing a gas containing cyanogen into the chamber; and exposing the titanium part placed within the chamber to the introduced gas containing cyanogen.

The method may further include exhausting the chamber of the gas containing cyanogen; and cooling and removing the titanium part placed within the chamber.

The evacuating or purging of the chamber may include removing substantially all air within the chamber after the titanium part is placed within the chamber, such that, the chamber is substantially free of at least one of oxygen, hydrogen, and humidity after evacuating or purging the chamber.

The evacuating or purging of the chamber may include replacing substantially all air within the chamber with an inert gas after the titanium part is placed within the chamber, such that, the chamber is substantially free of at least one of oxygen, hydrogen, and humidity after evacuating or purging the chamber.

The heating of the titanium part placed within the chamber may include heating the titanium part placed within the chamber after evacuating or purging the chamber.

The titanium part may be heated to an annealing temperature of the titanium part.

The titanium part may be heated to about a beta transus temperature for a titanium alloy of the titanium part.

The titanium part may be heated to a temperature of from about 1100° F. to about 1500° F.

The titanium part may be heated to a temperature of from about 1500° F. to about 1850° F.

The introducing of the gas containing cyanogen into the chamber may include introducing the gas containing cyanogen into the chamber after heating the titanium part placed within the chamber, such that, after introducing the gas containing cyanogen into the chamber, the chamber is substantially free of at least one of oxygen, hydrogen, and humidity.

The gas containing cyanogen may consist essentially of cyanogen.

The gas containing cyanogen may include cyanogen and from about 5% to about 95% diluent.

Introducing the gas containing cyanogen into the chamber may generate a pressure within the chamber from about 1 torr to about 760 torr.

The exposing of the titanium part placed within the chamber to the introduced gas containing cyanogen may include exposing the titanium part to the gas containing cyanogen after heating the titanium part placed within the chamber.

The titanium part may be exposed to the introduced gas containing cyanogen for about 3 hours to about 24 hours.

The titanium part may be exposed to the introduced gas containing cyanogen for about 1 hour to about 3 hours.

The exposing of the titanium part placed within the chamber to the introduced gas containing cyanogen may further include generating a plasma within the chamber to excite the introduced gas containing cyanogen.

After exposing the titanium part placed within the chamber to the introduced gas containing cyanogen, the titanium part may have a hardened case with a depth between from about 0.0001 inches and about 0.025 inches.

After exposing the titanium part placed within the chamber to the introduced gas containing cyanogen, the titanium part may have a hardened case with a depth of about 0.005 inches or greater.

After exposing the titanium part placed within the chamber to the introduced gas containing cyanogen, the titanium part may have a hardened case comprising from about 6.4 weight % to about 21.4 weight % carbon and nitrogen content, based on a total weight of the hardened case.

Further areas of applicability will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The accompanying drawings, which are incorporated in, and constitute a part of this specification, illustrate implementations of the present teachings and, together with the description, serve to explain the principles of the disclosure. In the figures.

Figure 1:
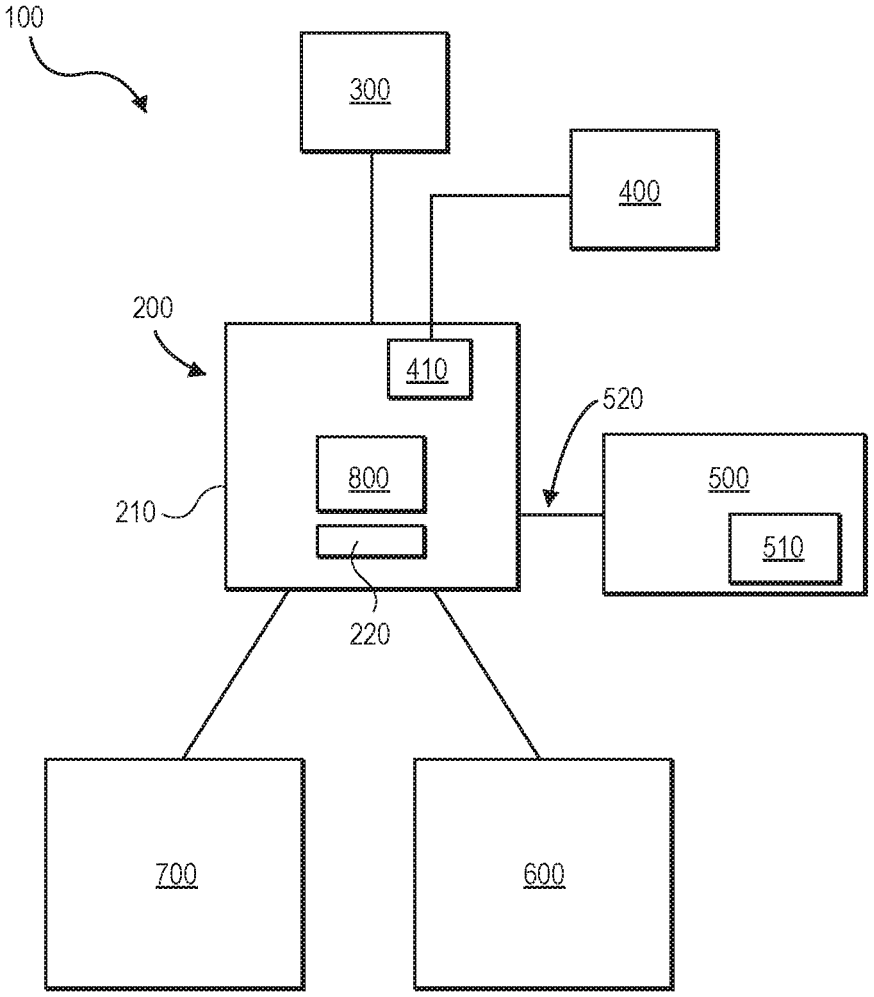
FIG. 1 illustrates a system for case hardening titanium parts according to an implementation.

It should be noted that some details of the figures have been simplified and are drawn to facilitate understanding of the present teachings rather than to maintain strict structural accuracy, detail, and scale.

DETAILED DESCRIPTION

Reference will now be made in detail to exemplary implementations of the present teachings, examples of which are illustrated in the accompanying drawings. Generally, the same reference numbers will be used throughout the drawings to refer to the same or like parts.

Throughout the specification and claims, the following terms take the meanings explicitly associated herein, unless the context clearly dictates otherwise. Phrases, such as, "in an implementation," "in certain implementations," and "in some implementations" as used herein do not necessarily refer to the same implementation(s), though they may. Furthermore, the phrases "in another implementation" and "in some other implementations" as used herein do not necessarily refer to a different implementation, although they may. As described below, various implementations can be readily combined, without departing from the scope or spirit of the present disclosure.

As used herein, the term "or" is an inclusive operator, and is equivalent to the term "and/or," unless the context clearly dictates otherwise. The term "based on" is not exclusive and allows for being based on additional factors not described, unless the context clearly dictates otherwise. In the specification, the recitation of "at least one of A, B, and C," includes implementations containing A, B, or C, multiple examples of A, B, or C, or combinations of A/B, A/C, B/C, A/B/B/B/B/C, A/B/C, etc. In addition, throughout the specification, the meaning of "a," "an," and "the" include plural references. The meaning of "in" includes "in" and "on."

It will also be understood that, although the terms first, second, etc. can be used herein to describe various elements, these elements should not be limited by these terms. These terms are only used to distinguish one element from another. For example, a first object, component, or step could be termed a second object, component, or step, and, similarly, a second object, component, or step could be termed a first object, component, or step, without departing from the scope of the invention. The first object, component, or step, and the second object, component, or step, are both, objects, component, or steps, respectively, but they are not to be considered the same object, component, or step. It will be further understood that the terms "includes," "including," "comprises" and/or "comprising," when used in this specification, specify the presence of stated features, steps, operations, elements, and/or components, but do not preclude the presence or addition of one or more other features, steps, operations, elements, components, and/or groups thereof. Further, as used herein, the term "if" can be construed to mean "when" or "upon" or "in response to determining" or "in response to detecting," depending on the context.

All physical properties that are defined hereinafter are measured at 20° to 25° Celsius unless otherwise specified.

When referring to any numerical range of values herein, such ranges are understood to include each and every number and/or fraction between the stated range minimum and maximum, as well as the endpoints. For example, a range of 0.5% to 6% would expressly include all intermediate values of, for example, 0.6%, 0.7%, and 0.9%, all the way up to and including 5.95%, 5.97%, and 5.99%, among many others. The same applies to each other numerical property and/or elemental range set forth herein, unless the context clearly dictates otherwise.

Additionally, all numerical values are "about" or "approximately" the indicated value, and take into account experimental error and variations that would be expected by a person having ordinary skill in the art. It should be appreciated that all numerical values and ranges disclosed herein are approximate values and ranges, whether "about" is used in conjunction therewith.

As used herein, "free" or "substantially free" of a material or substance may refer to when the material is present in an amount small enough to have zero or negligible effects on a desired result. For example, an atmosphere may be "free" or "substantially free" or substantially free of oxygen if the amount of oxygen has at most a negligible effect. In some implementations, "free" or "substantially free" may refer to less than 20 ppm, less than 10 ppm, and less than 5 ppm, of a specific material, such as oxygen or hydrogen.

Unless otherwise specified, all percentages and amounts expressed herein and elsewhere in the specification should be understood to refer to percentages by weight of total solids. The percentages and amounts given are based on the active weight of the material. For example, for an active ingredient provided as a solution, the amounts given are based on the amount of the active ingredient without the amount of solvent or may be determined by weight loss after evaporation of the solvent.

With regard to procedures, methods, techniques, and workflows that are in accordance with some implementations, some operations in the procedures, methods, techniques, and workflows disclosed herein can be combined and/or the order of some operations can be changed.

The inventors have created new systems and methods to case harden titanium or titanium alloy parts and articles. The system may use cyanogen, N≡C—C≡N which, in some instances, may be a combustible and/or toxic material. However, other combustible gases, such as acetylene and hydrogen, are routinely used in heat treating processes. Appropriate safety practices and equipment may be used to decrease and/or eliminate the risk of combustibility and toxicity, and to render the processes of the present disclosure easily and safely managed.

The present inventors have moved beyond the roadblocks of combustibility and toxicity and developed a unique process for case hardening of a titanium part within a chamber and using cyanogen, the details of the process will now be described herein.

FIG. 1 illustrates a system for case hardening titanium parts according to an implementation. As illustrated in FIG. 1, a system 100 to case harden a titanium part 800 may include a chamber 200, a vacuum system 300, a heating system 400, and a gas system 500.

In one implementation, the system 100 is configured to expose the titanium part 800 to a gas containing cyanogen within the chamber 200 to case harden the titanium part 800. The titanium part 800 may be exposed to the gas containing cyanogen while being heated and/or under pressure during the case hardening process.

The titanium part 800 may take a number of different forms. For example, the titanium part 800 may be embodied as a gear, a bearing, a crankshaft, a camshaft, a cam follower, a valve, an extruder screw, a die, a bushing, a pin, an injector, and/or any other suitable type of part or article made of titanium or a titanium alloy.

However, the titanium part 800 is not limited thereto, and the titanium part 800 may be embodied as other types of parts. Similarly, the titanium part 800 may take different forms. For example, the titanium part 800 may comprise titanium and titanium alloys.

The chamber 200 may be configured to hold a titanium part 800 during a case hardening process. The chamber 200 may include a housing 210 and a part holder 220. The part holder 220 may be configured to hold the titanium part 800 within the chamber 200 during the case hardening process.

The vacuum system 300 may be functionally connected to the chamber 200 and may be configured to create a vacuum within the chamber 200. For example, the vacuum system 300 may remove substantially all of the air within the chamber 200.

Oxygen and hydrogen may compromise the mechanical properties of the of titanium part 800 during the case hardening process alloys by turning it more brittle. Accordingly, in certain implementations, after the vacuum is created, the chamber 200 may be substantially free of oxygen. In other implementations, after the vacuum is created, the chamber 200 may be substantially free of hydrogen. In yet other implementations, after the vacuum is created, the chamber 200 may be substantially free of humidity.

In other implementations, the vacuum system 300 may be functionally connected to the chamber 200 and may be configured to purge the chamber 200. For example, the vacuum system 300 may replace substantially all of the air within the chamber 200 with an inert gas. In certain implementations, after purging with inert gas, the chamber 200 may be substantially free of oxygen. In other implementations, after purging with inert gas, the chamber 200 may be substantially free of hydrogen. In yet other implementations, after purging with inert gas, the chamber 200 may be substantially free of humidity. For example, after purging with inert gas, the atmosphere within the chamber 200 may comprises less than 10 ppm oxygen or hydrogen.

In one implementation, the inert gas includes argon. In other implementations, the inert gas consists essentially of argon.

The heating system 400 may be functionally connected to the chamber 200 and may be configured to heat the titanium part 800 with the chamber 200.

The heating system 400 may be implemented as an induction heating system 400 and may be configured to generate electrical eddy currents in the titanium part 800 and/or a portion thereof. An electrical resistance within a portion of the titanium part 800 may generate a heat in response to the eddy currents and other portions of the titanium part 800 may be heated through conduction.

The heating system 400 may be implemented as a resistive heating system 400 and may be configured to heat the titanium part 800 by radiation and conduction. For example, a resistive element 410 may be disposed within the chamber 200, and the resistive element 410 may heat the titanium part 800 when supplied with an electrical current.

The heating system 400 may be configured to heat the titanium part 800 to a desired temperature or temperature range. The desired temperature may be maintained at a particular temperature within a temperature range or may be varied within the temperature range.

The desired temperature may correspond to a composition of the titanium part 800. For example, the titanium part 800 may be heated to an annealing temperature for the titanium part 800. The titanium part 800 may be heated to a temperature from about 1100° F. to about 1500° F. For example, the titanium part 800 may be heated up to 1500° F., up to 1400° F., up to 1300° F., and up to 1200° F.

In some implementations, the desired temperature may be used to control the case hardening process. For example, a lower temperature may be used to produce thin cases in a slow and controlled manner, while higher temperatures may be used to produce thicker cases and/or improve the speed at which cases are created on the titanium part 800.

In other implementations, the titanium part 800 may be heated to about the beta transus temperature for a particular alloy of the titanium part 800. Heating to near the beta transus temperature may allow core heat treatment for the titanium part 800. Accordingly, the titanium part 800 may be heated to a temperature from about 1500° F. to about 1850° F. For example, the titanium part 800 may be heated up to 1800° F., up to 1750° F., up to 1700° F., up to 1650° F., up to 1600° F., and up to 1550° F.

In some implementations, the case hardening process may be followed up with rapid quenching, such as liquid rapid quenching, followed by age hardening.

The titanium part 800 may be heated for a desired period of time. For example, the titanium part 800 may be heated, without limitations, for at least 30 minutes, at least 1 hour, at least 2 hours, at least 3 hours, at least 4 hours, at least 6 hours, at least 12 hours, and at least 24 hours. In one implementation, the titanium part 800 is heated for about 1 hour to about 3 hours. In another implementation, the titanium part 800 is heated for about 3 hours to about 24 hours.

In some implementations, the desired period of time may be used to control the depth of the hardening. For example, a shorter period of time may be used to produce a thin case on the titanium part 800. Similarly, a longer period of time may be used to produce a thicker case on the titanium part 800.

The gas system 500 may be functionally connected to the chamber 200 and may be configured to deliver a gas to the chamber 200. For example, the gas system 500 may include a gas supply 510 configured to hold a gas and a gas delivery 520 connected to the gas supply 510 and the chamber 200 to deliver the gas from the gas supply 510 to the chamber 200.

In one implementation, the gas system 500 may introduce the gas to the chamber 200 after the vacuum system 300 has removed substantially all of the air within the chamber 200. In another implementation, the gas system 500 may introduce the gas to the chamber 200 after the vacuum system 300 has replaced substantially all of the air within the chamber 200 with an inert gas.

The gas may include cyanogen (formula $(CN)_2$). The gas may consist essentially of cyanogen. In other implementations, the gas may include a diluent. For example, the gas may include an inert gas, such as argon, as a diluent. In some implementations, the gas consists essentially of cyanogen and an inert gas. In other implementations, the gas is substantially free of oxygen or hydrogen. For example, the gas may contain less than 20 ppm, less than 10 ppm, or less than 5 ppm of oxygen or hydrogen. In other implementations, the gas may contain less than 4 ppm, less than 3 ppm, less than 2 ppm, or less than 1 ppm of oxygen or hydrogen.

The diluent may be used to control a concentration of cyanogen within the gas, such that the intensity of the surface reactions between the cyanogen gas and the titanium part 800 may be controlled. For example, a diluent may be used to reduce the concentration of the hardening species (C, N) present in the gas, and thus, preserving more of the metallic character of the titanium part 800.

The diluent may consist essentially of an inert gas, such as argon. In some implementations, the gas may include from about 5% to about 95% diluent. For example, the gas may include from about 5% to about 95% of an inert gas, such as argon. In other implementations, the gas may include 99% or less diluent, 95% or less diluent, 90% or less diluent, 80% or less diluent, 70% or less diluent, 60% or less diluent, 50% or less diluent, 40% or less diluent, 30% or less diluent, 20% or less diluent, 10% or less diluent, or 5% or less diluent.

In other implementations, the gas may include from about 5% to about 95% cyanogen. The gas may include 99% or less cyanogen, 95% or less cyanogen, 90% or less cyanogen, 80% or less cyanogen, 70% or less cyanogen, 60% or less cyanogen, 50% or less cyanogen, 40% or less cyanogen, 30% or less cyanogen, 20% or less cyanogen, 10% or less cyanogen, or 5% or less cyanogen.

After the gas system 500 delivers the gas to the chamber 200, the atmosphere within the chamber 200 consists essentially of the gas. In other implementations, after the gas system 500 delivers the gas to the chamber 200, the atmosphere within the chamber 200 is substantially free of at least one of oxygen, hydrogen, or humidity. For example, the atmosphere within the chamber 200 may contain less than 20 ppm, less than 10 ppm, or less than 5 ppm of oxygen or hydrogen. In some implementations, the gas containing cyanogen consists essentially of cyanogen. In other implementations, the gas containing cyanogen comprises cyanogen and a diluent.

The gas system 500 may deliver the gas into the chamber 200 such that a pressure may be generated within the chamber 200.

For example, after the gas system 500 delivers the gas to the chamber 200, the pressure within the chamber 200 may be from about 1 torr to about 760 torr. For example, after the gas system 500 delivers the gas to the chamber 200, the pressure may be up to about 700 torr, up to about 600 torr, up to about 500 torr, up to about 400 torr, up to about 300 torr, up to about 200 torr, up to about 100 torr, and/or up to about 50 torr. In one implementation, after the gas system 500 delivers the gas to the chamber 200, the pressure within the chamber 200 may be from about 1 torr to about 20 torr.

In some implementations, the pressure within the chamber 200 may be used to control a concentration of the hardening species (C, N) in the atmosphere within the chamber 200. For example, a low pressure may be used to reduce the concentration of the hardening species (C, N) present in the atmosphere within the chamber 200, and thus, preserving more of the metallic character of the titanium part 800.

The gas system 500 may deliver the gas into the chamber 200 at a desired gas flow rate. The gas flow rate may be used to refresh the gas and the atmosphere within the chamber 200. The gas flow rate may also be used to remove by-products during a case hardening process.

For example, if the gas flow rate is too low, too many by-products may accumulate, and the reactive species in the gas (C, N) may become depleted. Similarly, if the gas flow rate is too high, too much of the reactive species in the gas (C, N) may pass through the chamber 200 unreacted. An excessive gas flow rate may increase operating costs and carry away heat from the chamber 200.

The titanium part 800 may be exposed to the gas for a desired period of time after the gas system 500 delivers the gas to the chamber 200 and/or a desired pressure or gas flow is achieved. For example, the titanium part 800 may be exposed to the gas, without limitations, for at least 30 minutes, at least 1 hour, at least 2 hours, at least 3 hours, at least 4 hours, at least 6 hours, at least 12 hours, and at least 24 hours. In one implementation, the titanium part 800 is exposed to the gas for about 1 hour to about 3 hours. In another implementation, the titanium part 800 is exposed to the gas for about 3 hours to about 24 hours.

In some implementations, the exposure time may be used to control the case hardening process. For example, a shorter exposure time may be used to produce a thin case on the titanium part 800. Similarly, a longer exposure time may be used to produce a thicker case on the titanium part 800.

In some implementations, the system 100 is configured to expose the titanium part 800 to a gas containing cyanogen while simultaneously being heated to the desired temperature. For example, the titanium part 800 may be disposed within the chamber 200, and the gas system 500 may deliver a gas containing cyanogen into the chamber 200. The titanium part 800 may be heated while exposed to the gas containing cyanogen. The gas introduced into the chamber 200 may generate a pressure within the chamber 200 while the titanium part 800 is heated and/or exposed to the gas containing cyanogen.

The system 100 may further include a plasma system 600. The plasma system 600 may be functionally connected to the chamber 200 and/or may be placed within the chamber 200. The plasma system 600 and may be configured to create a plasma within the chamber 200.

For example, the plasma system 600 may be configured to apply a voltage between the titanium part 800 and a wall of the chamber 200 and/or housing 210 to generate a glow discharge with a high ionization (plasma) around the titanium part 800. In some implementations, a surface area of the titanium part 800 directly charged by the ions helps release active nitrogen and carbon atoms from the cyanogen containing gas onto the surface of the titanium part 800 to enhance a chemical activity of the process gas and improve the case uniformity over large surfaces or into holes and gaps.

In one implementation, the plasma system 600 applies a plasma to the cyanogen gas to excite an atmosphere within the chamber 200 and enhance a case hardening process. For example, the plasma system 600 may be used for generating a plasma within the chamber to excite the introduced gas containing cyanogen. In some implementations, the titanium part 800 may be negatively charged with respect to the surrounding walls of the chamber 200.

The plasma system 600 may be used to control the case hardening process. For example, the plasma system 600 may generate a plasma to enhance an activity of the hardening species (C, N) in the gas via ionization. The plasma may also control mass transfer, mitigating the starvation of the hardening species (C, N) in large loads of titanium parts 800 or in holes, gaps, and crevices of the titanium part 800.

The system 100 may further include an exhaust system 700. The exhaust system 700 may be functionally connected to the chamber 200 and may be configured to exhaust the gas from the chamber 200 and/or vent the chamber 200. In some implementations, the exhaust system is configured to treat the gas and/or atmosphere within the chamber 200 before exhausting or venting the chamber 200. For example, the exhaust system 700 may be configured to burn off the gas and/or atmosphere within the chamber 200 before venting.

Figure 2:
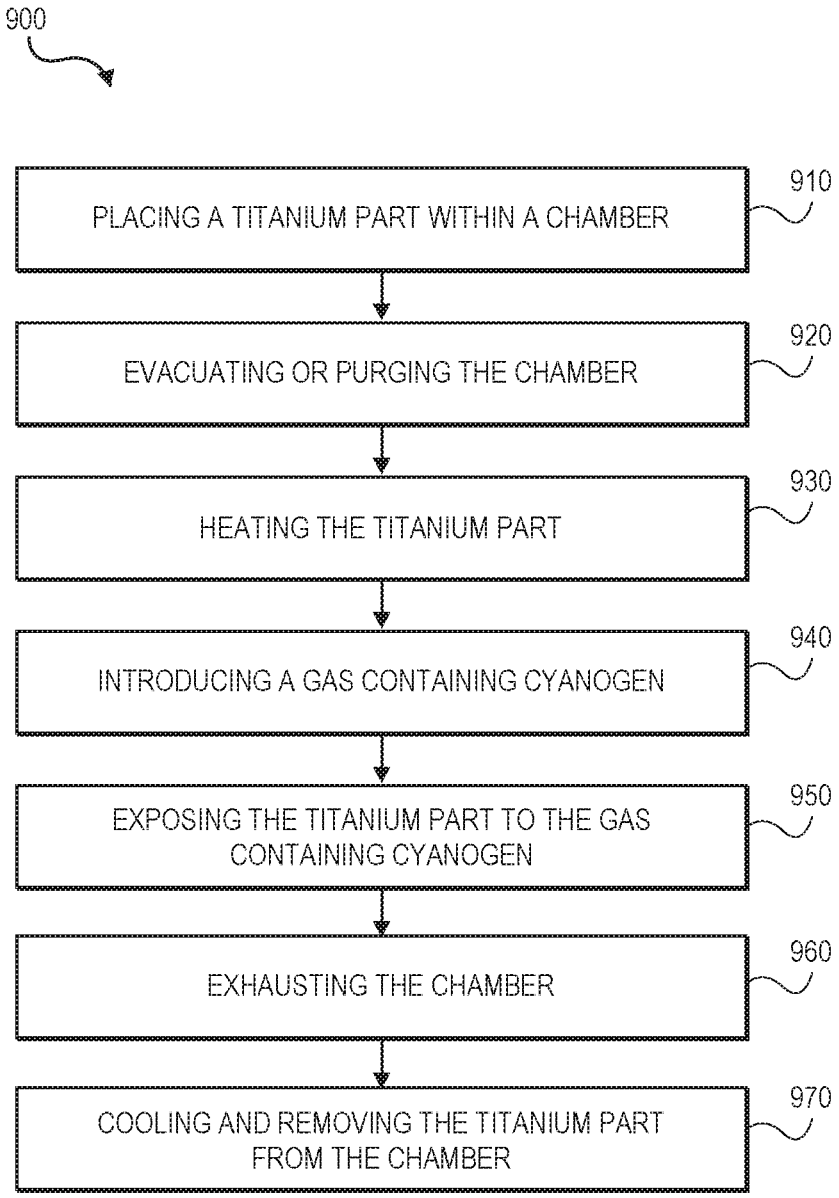
FIG. 2 illustrates a method for case hardening titanium parts according to an implementation.

FIG. 2 illustrates a method for case hardening titanium parts according to an implementation. As illustrated in FIG.

2, a method 900 for case hardening titanium parts may be described with respect to the system 100 of FIG. 1.

The method 900 may begin with placing a titanium part 800 within a chamber 200 in operation 910. The chamber 200 may include a part holder 220 configured to hold the titanium part 800 within the chamber 200 during the case hardening process.

In operation 920, the atmosphere within the chamber 200 is evacuated or purged. For example, a vacuum system 300 may be used to remove substantially all of the air within the chamber 200. In other implementations, the vacuum system 300 may be used to replace substantially all of the air within the chamber 200 with an inert gas, such as argon. After evacuating or purging, the chamber 200 may be substantially free of oxygen, may be substantially free of hydrogen, and/or may be substantially free of humidity.

In operation 930, the titanium part 800 is heated. For example, the heating system 400 may be used to heat the titanium part 800 placed within the chamber 200 to a desired temperature. The titanium part 800 may be heated in a vacuum or in an inert atmosphere. The titanium part 800 may be heated to an annealing temperature or a beta transus temperature.

In operation 940, a gas containing cyanogen is introduced. For example, a gas system 500 may be used to introduce a gas containing cyanogen into the chamber 200. The gas containing cyanogen may include a diluent, such as argon. The gas containing cyanogen may consist essentially of cyanogen.

In some implementations, the chamber 200 lacks any other source of carbon or nitrogen, except for the gas containing cyanogen provided to the chamber 200.

In operation 950, the titanium part 800 is exposed to the gas containing cyanogen. For example, the titanium part 800 placed within the chamber 200 may be exposed to the gas containing cyanogen while the titanium part 800 is heated and/or is at the desired temperature. The titanium part 800 may be exposed to the gas containing cyanogen for a desired period of time. For example, the titanium part 800 may be exposed to the gas containing cyanogen, without limitations, for at least 30 minutes, at least 1 hour, at least 2 hours, at least 3 hours, at least 4 hours, at least 6 hours, at least 12 hours, and at least 24 hours. In one implementation, the titanium part 800 is exposed to the gas containing cyanogen for about 1 hour to about 3 hours. In another implementation, the titanium part 800 is exposed to the gas containing cyanogen for about 3 hours to about 24 hours.

In some implementations, a plasma may be applied to the gas containing cyanogen to facilitate a case hardening process. For example, the plasma system 600 may be used to generate a plasma around the titanium part 800 to enhance a case hardening process. In some implementations, the plasma is generated after the titanium part 800 is at the desired temperature. In other implementations, the plasma is generated after the titanium part 800 is exposed to the gas containing cyanogen. In yet other implementations, the plasma may be generated in an inert atmosphere, before the gas containing cyanogen is introduced and as the titanium part 800 approaches the desired temperature. This may allow stabilization of the plasma while any surface contamination on the titanium part 800 is burned off.

In operation 960, the chamber 200 is exhausted. For example, after the titanium part 800 has been heated and exposed to the gas containing cyanogen in the chamber 200, the exhaust system 700 may be used to exhaust the gas containing cyanogen from the chamber 200. In other implementations, the chamber 200 may be purged with an inert gas.

In operation 970, the titanium part 800 is allowed to cool and is removed from the chamber 200.

In some implementations, after being heated and exposed to the gas containing cyanogen, the titanium part 800 has a hardened case with a depth between from about 0.0001 inches and about 0.025 inches. In other implementations, after being heated and exposed to the gas containing cyanogen, the titanium part 800 has a hardened case with a depth of about 0.005 inches or greater.

In some implementations, the titanium part 800 has a hardened case that is free or substantially free of oxygen and/or hydrogen.

In some implementations, after being heated and exposed to the gas containing cyanogen, the titanium part 800 has a hardened case comprising from about 6.4 weight % to about 21.4 weight % carbon and nitrogen content, based on the total weight of the hardened case.

Figure 3:
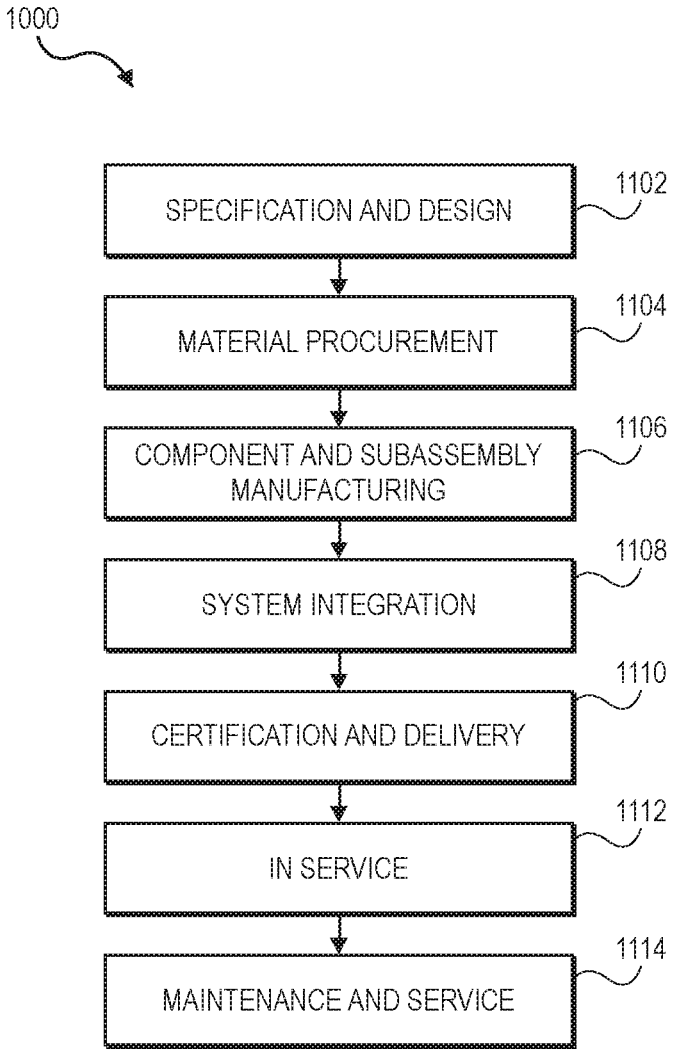
FIG. 3 illustrates a flow diagram of aircraft production and service methodology.
Figure 4:
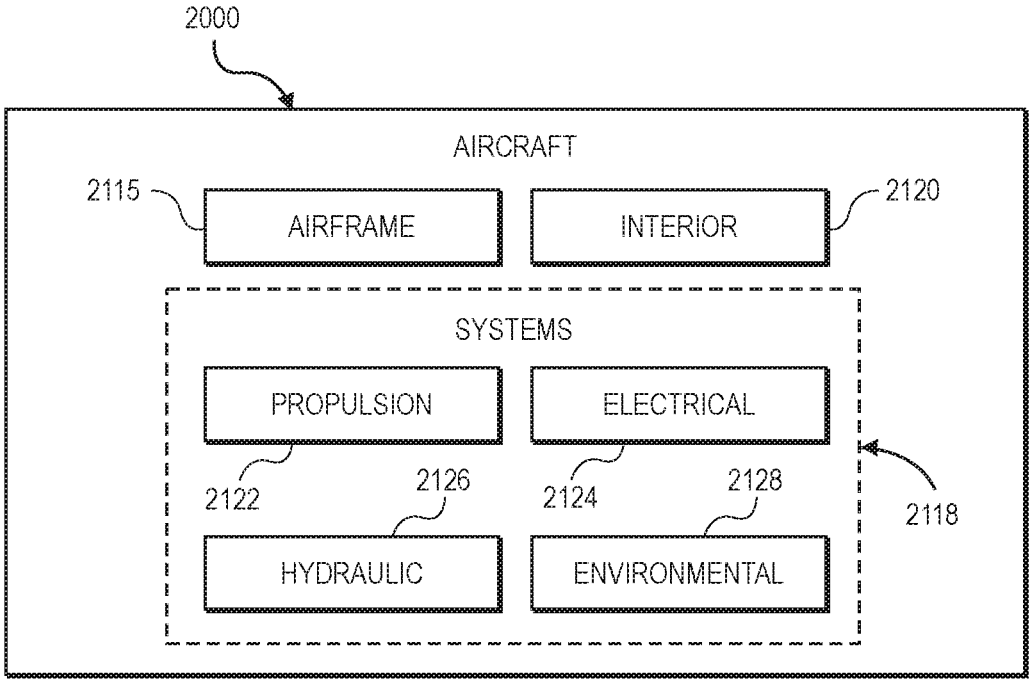
FIG. 4 illustrates a block diagram of an aircraft.

Implementations of the present disclosure may find use in a variety of potential applications, particularly in the transportation industry, including for example, aerospace, marine, automotive applications, and other application where case hardened titanium parts or articles are desired. Thus, referring now to FIGS. 3 and 4, implementations of the disclosure may be used in the context of an aircraft manufacturing and service method 1000 as shown in FIG. 3 and an aircraft 2000 as shown in FIG. 4. During pre-production, exemplary method 1000 may include specification and design 1102 of the aircraft 2000 and material procurement 1104. During production, component and subassembly manufacturing 1106 and system integration 1108 of the aircraft 2000 takes place. Thereafter, the aircraft 2000 may go through certification and delivery 1110 in order to be placed in service 1112. While in service by a customer, the aircraft 2000 is scheduled for routine maintenance and service 1114, which may also include modification, reconfiguration, refurbishment, and so on.

Each of the processes of method 1000 may be performed or carried out by a system integrator, a third party, and/or an operator (e.g., a customer). For the purposes of this description, a system integrator may include without limitation any number of aircraft manufacturers and major-system subcontractors; a third party may include without limitation any number of vendors, subcontractors, and suppliers; and an operator may be an airline, leasing company, military entity, service organization, and so on.

As shown in FIG. 4, the aircraft 2000 produced by exemplary method 1000 may include an airframe 2116 with a plurality of systems 2118 and an interior 2120. Examples of high-level systems 2118 include one or more of a propulsion system 2122, an electrical system 2124, a hydraulic system 2126, and an environmental system 2128. Any number of other systems may be included. Although an aerospace example is shown, the principles of the disclosure may be applied to other industries, such as the marine and automotive industries.

Systems and methods embodied herein may be employed during any one or more of the stages of the production and service method 1000. For example, components or subassemblies corresponding to production process 1106 may be fabricated or manufactured in a manner similar to components or subassemblies produced while the aircraft 2000 is in service. Also, one or more apparatus embodiments, method embodiments, or a combination thereof may be utilized during the production stages 1106 and the 1108, for example, by substantially expediting assembly of or reducing the cost of an aircraft 2000. Similarly, one or more of apparatus embodiments, method embodiments, or a combination thereof may be utilized while the aircraft 2000 is in service, for example and without limitation, to maintenance and service 1114.

While FIGS. 3 and 4 describe the disclosure with respect to aircraft and aircraft manufacturing and servicing, the present disclosure is not limited thereto. The system and method of the present disclosure may also be used for case hardening of titanium parts and articles for spacecraft, satellites, submarines, surface ships, automobiles, tanks, trucks, power plants, and any other suitable type of objects.

The present disclosure has been described with reference to exemplary implementations. Although a few implementations have been shown and described, it will be appreciated by those skilled in the art that changes can be made in these implementations without departing from the principles and spirit of preceding detailed description. It is intended that the present disclosure be construed as including all such modifications and alterations insofar as they come within the scope of the appended claims or the equivalents thereof

What is claimed, is:

1. A method of case hardening a titanium part, comprising:

placing the titanium part within a chamber;

evacuating the air within the chamber or purging the air within the chamber with an inert gas;

heating the titanium part placed within the chamber;

introducing a gas containing cyanogen into the chamber; and exposing the titanium part placed within the chamber to the introduced gas containing cyanogen, wherein the gas containing cyanogen comprises cyanogen and from about 5% to about 95% diluent.

2. The method of claim 1, further comprising:

exhausting the chamber of the gas containing cyanogen; and cooling and removing the titanium part placed within the chamber.

3. The method of claim 1, wherein the evacuating or purging of the chamber comprises:

removing the air within the chamber after the titanium part is placed within the chamber, such that, the chamber comprises less than 20 ppm of oxygen or hydrogen after evacuating or purging the chamber.

4. The method of claim 1, wherein the evacuating or purging of the chamber comprises:

replacing the air within the chamber with an inert gas after the titanium part is placed within the chamber, such that, the chamber comprises less than 20 ppm of oxygen or hydrogen after evacuating or purging the chamber.

5. The method of claim 1, wherein the heating of the titanium part placed within the chamber comprises:

heating the titanium part placed within the chamber after evacuating or purging the chamber.

6. The method of claim 5, wherein the titanium part is heated to an annealing temperature of the titanium part.

7. The method of claim 5, wherein the titanium part is heated to about a beta transus temperature for a titanium alloy of the titanium part.

8. The method of claim 5, wherein the titanium part is heated to a temperature of from about 1100° F. to about 1500° F.

9. The method of claim 5, wherein the titanium part is heated to a temperature of from about 1500° F. to about 1850° F.

10. The method of claim 1, wherein the introducing of the gas containing cyanogen into the chamber comprises:

introducing the gas containing cyanogen into the chamber after heating the titanium part placed within the chamber, such that, after introducing the gas containing cyanogen into the chamber, the chamber comprises less than 20 ppm of oxygen or hydrogen.

11. The method of claim 1, wherein the gas containing cyanogen consists essentially of cyanogen.

12. The method of claim 10, wherein introducing the gas containing cyanogen into the chamber generates a pressure within the chamber from about 1 torr to about 760 torr.

13. The method of claim 1, wherein the exposing of the titanium part placed within the chamber to the introduced gas containing cyanogen comprises:

exposing the titanium part to the gas containing cyanogen after heating the titanium part placed within the chamber.

14. The method of claim 13, wherein the titanium part is exposed to the introduced gas containing cyanogen for about 3 hours to about 24 hours.

15. The method of claim 13, wherein the titanium part is exposed to the introduced gas containing cyanogen for about 1 hour to about 3 hours.

16. The method of claim 13, wherein the exposing of the titanium part placed within the chamber to the introduced gas containing cyanogen further comprises:

generating a plasma within the chamber to excite the introduced gas containing cyanogen.

17. The method of claim 1, wherein after exposing the titanium part placed within the chamber to the introduced gas containing cyanogen, the titanium part has a hardened case with a depth between from about 0.0001 inches and about 0.025 inches.

18. The method of claim 1, wherein after exposing the titanium part placed within the chamber to the introduced gas containing cyanogen, the titanium part has a hardened case with a depth of about 0.005 inches or greater.

19. A method of case hardening a titanium part, comprising:

placing the titanium part within a chamber;

evacuating the air within the chamber or purging the air within the chamber with an inert gas;

heating the titanium part placed within the chamber;

introducing a gas containing cyanogen into the chamber; and exposing the titanium part placed within the chamber to the introduced gas containing cyanogen, wherein after exposing the titanium part placed within the chamber to the introduced gas containing cyanogen, the titanium part has a hardened case comprising from about 6.4 weight % to about 21.4 weight % carbon and nitrogen content, based on a total weight of the hardened case.

20. A method of case hardening a titanium part, comprising:

placing the titanium part within a chamber;

evacuating the air within the chamber or purging the air within the chamber with an inert gas;

heating the titanium part placed within the chamber;

introducing a gas containing cyanogen into the chamber; and exposing the titanium part placed within the chamber to the introduced gas containing cyanogen, wherein after introducing the gas containing cyanogen into the chamber, the chamber comprises less than 20 ppm of oxygen or hydrogen, and wherein introducing the gas containing cyanogen into the chamber generates a pressure within the chamber from about 1 torr to about 760 torr.

* * * * *